US007695349B2

(12) United States Patent
Mase et al.

(10) Patent No.: US 7,695,349 B2
(45) Date of Patent: Apr. 13, 2010

(54) APPARATUS FOR SUPPLYING CONSTANT QUANTITY OF ABRASIVE

(75) Inventors: Keiji Mase, Tokyo (JP); Ryoji Kikuchi, Tokyo (JP)

(73) Assignee: Fuji Manufacturing Co., Ltd., Tokyo (JP)

( * ) Notice: Subject to any disclaimer, the term of this patent is extended or adjusted under 35 U.S.C. 154(b) by 14 days.

(21) Appl. No.: 12/078,679

(22) Filed: Apr. 3, 2008

(65) Prior Publication Data

US 2008/0261496 A1 Oct. 23, 2008

(30) Foreign Application Priority Data

Apr. 18, 2007 (JP) ..... 2007-109589

(51) Int. Cl.
*B07C 5/36* (2006.01)

(52) U.S. Cl. ..... 451/99; 222/169; 451/446

(58) Field of Classification Search ..... 451/38, 451/94, 95, 99, 446; 222/169, 170, 367
See application file for complete search history.

(56) References Cited

U.S. PATENT DOCUMENTS 6,200,203 B1 * 3/2001 Xu et al. ..... 451/99
2009/0075569 A1 * 3/2009 Mase et al. ..... 451/99

FOREIGN PATENT DOCUMENTS

| | | |
|---|---|---|
| JP | 09-038864 | 2/1997 |
| JP | 10-249732 | 9/1998 |
| JP | 11-347946 | 12/1999 |
| JP | 2000-000768 | 1/2000 |
| JP | 2004-154901 | 6/2004 |

* cited by examiner

*Primary Examiner*—Timothy V Eley
(74) *Attorney, Agent, or Firm*—Porzio, Bromberg & Newman, P.C.

(57) ABSTRACT

To provide an apparatus for supplying a constant quantity of abrasive that can accurately control abrasive quantity supplied to a blasting machine.

A rotating disk 20 that rotates in the horizontal direction is provided inside an abrasive tank 10, with a gap 3 being capable to rotate the rotating disk 20, being formed at an end 11*a* of a mixed fluid flow path 11 arranged on one surface of the rotating disk 20, and at an end 12*a* of a gas flow path 12 arranged facing other surface of the rotating disk 20 via the rotating disk 20 at the end 11*a* of the mixed fluid flow path 11. Hole sections 21 are provided in the rotating disk 20 on a rotation locus passing through the gap 3, equally spaced and passing through in a thickness direction of the rotating disk 20, with stirrer blades 22 protruding from the upper surface of the rotating disk 20, and the rotating disk 20 being immersed in abrasive stored inside the abrasive tank 10, except for a part positioned in the gap 3.

14 Claims, 7 Drawing Sheets

Prior Art

Prior Art

Prior Art

APPARATUS FOR SUPPLYING CONSTANT QUANTITY OF ABRASIVE

BACKGROUND OF THE INVENTION

1. Field of the Invention

The present invention relates to an apparatus for supplying a constant quantity of abrasive, and in more detail relates to an apparatus in a blasting machine for controlling to keep a quantity of adhesive in a constant quantity to be ejected from a blast gun or nozzle of the blasting machine as for a mixture of a compressed fluid such as compressed air or gas and abrasive using the blast gun.

2. Description of the Related Art

In a blasting machine for ejecting a mixed fluid of compressed gas and abrasive, if fluctuations arise in the quantity of abrasive to be ejected, a precision of machining of a workpiece will vary due to fluctuations of degree in the processing. Thus, there has been proposed an apparatus for supplying a constant quantity of abrasive for obtaining a mixed fluid by supplying a constant quantity of abrasive with a compressed fluid to be ejected from a blast gun, so as to make the abrasive to be ejected always a constant quantity.

An example of such an apparatus for supplying a constant quantity of abrasive will be described taking the apparatus used in a suction type blasting machine as an example, with reference to FIG. 5 and FIG. 6.

The suction type blasting machine is provided with a conduit for compressed air 46 inside a blast gun, and a branched conduit 42 branching from this conduit 46, as shown in FIG. 5, and if high pressure compressed air is supplied to the inside of the conduit for compressed air 46, abrasive is sucked via the branched conduit 42 by the suction force (suction negative pressure) generated at that time, and ejected together with the compressed air. An apparatus for supplying a constant quantity of abrasive 1 used in this type of the suction blasting machine is provided with an abrasive conduit 44, which is a branched conduit converging with the previously described conduit for compressed air 46, an abrasive tank 10 that is communicated with the abrasive conduit 44, and means for supplying abrasive inside the abrasive tank 10 to the abrasive conduit 44.

As this means for supplying a constant quantity of abrasive inside the abrasive tank 10 to the abrasive piping 44 at a time, with the apparatus for supplying a constant quantity of abrasive 1 shown in FIG. 5 and FIG. 6, a drum 50 having a plurality of V-shaped grooves 47 formed on an outer surface is rotatably housed in a state immersed in abrasive inside the abrasive tank 10 such that the peripheral surface of the drum 50 is partially exposed above the abrasive, and by arranging one end 45 of the abrasive conduit 44 facing the grooves 47 at the outer periphery of the drum 50 exposed above the abrasive, abrasive that has been collected inside the grooves 47 by rotation of the drum 50 is sucked into the abrasive conduit 44, is mixed with compressed air flowing in the conduit for compressed air 46, then ejected from the tip of a blast gun (not shown).

Accordingly, by controlling the rotational speed of an electric motor 30 for rotational drive of the drum 50 using an inverter, for example, it is possible to control a quantity of abrasive to be ejected in accordance with variation in this rotational speed (Japanese Unexamined Patent Publication No. Hei. 9-38864; hereinafter referred to as "864").

Also, in the case where this type of apparatus for supplying a constant quantity of abrasive is utilized in a direct pressure type blasting machine, then as shown in FIG. 7, a drum 50 with a plurality of rectangular indented sections 49 for measuring a constant quantity of abrasive at a time, formed on an outer periphery is arranged inside an abrasive tank 10, one end of an abrasive conduit 44, having other end 45 opening to the indented sections 49 provided on the drum 50, communicates with a conduit for compressed air 46 (here, also used as a mixed fluid conduit) in which compressed air that will be ejected from the tip of a blast gun (not shown) flows, with a duct 43 being further provided in the abrasive conduit 44, for supplying compressed air to the abrasive conduit 44, and by sucking compressed air into the indented sections 49 using the compressed air supplied via the duct 43 to the abrasive conduit 44 to blow the abrasive that has been collected in the indented section 49 upwards and mix it with compressed air flowing in the conduit for compressed air 46, it is possible to eject a constant quantity of abrasive together with compressed air from the blast gun at a time.

With the apparatus for supplying a constant quantity of abrasive 1 used in this direct pressure type blasting machine also, similarly to that for the previously described suction type blasting machine, it is possible to control the quantity of abrasive to be ejected from the blast gun by controlling the rotational speed of a motor for turning the drum 50 using an inverter or the like (Japanese unexamined patent No. Hei. 11-347946; hereinafter referred to as "'946").

An apparatus for supplying a constant quantity of abrasive has also been proposed in which instead of the indented sections for measuring abrasive in '946, holes passing through in the thickness direction of a rotating disk are formed, making it possible to collect abrasive inside these holes (Japanese unexamined patent No. 10-249732; hereinafter referred to as "'732").

With respect to the apparatus for supplying a constant quantity of abrasives 1 of the related art as described above, in the case of said apparatus 1 disclosed in '864 and '946 cited above, both have abrasive measurement carried out by bottomed rectangular grooves 47 or indented sections 49 formed on the outer periphery of a drum 50, but even if such grooves 47 or indented sections 49 are formed anywhere over the entire periphery of the drum 50, it is necessary to have extremely high machining accuracy in forming them to a uniform depth. For this reason, formation differences in the grooves 47 and indented section 49 occurring at the time of manufacture will be a direct cause of errors in the quantity of measured abrasive.

However, particularly with the indented sections 49 as shown in '946 cited above, in the event that that they are formed as comparatively deeper holes with the bottoms, it is difficult for abrasive to enter into the inside of the holes, and as well as variations arising in the quantity of abrasive collected inside each indented section 49, there may be cases where once abrasive goes in to an inside of the indented section 49, it is impossible to extract all of the abrasive by blowing compressed air, and the quantity of abrasive collected inside each of the indented section 49 being a constant quantity, and the abrasive extracted from the indented sections 49 being a constant quantity, inherently have low reliability.

This point, although not shown in the drawings, is because with the apparatus for supplying a constant quantity of abrasive 1 disclosed in '732 cited above, hole sections passing through a circular disk in a thickness direction are provided, and measurement of the abrasive is performed with these hole sections, which means that if the disk thickness is constant, the depth (length) of the formed holes can be made constant, and compared to the previously described case of the holes with bottoms, it is easier to get the abrasive to flow and to get it out again.

However, even if no error in quantity of abrasive arises between each hole section, there are cases where an insufficient quantity of abrasive enters into the hole sections, or where even when a required quantity of abrasive has been collected inside the hole section, the abrasive falls out of the grooves 47 or hole sections after collection while being supplied to the abrasive conduit 44, and in the related art structures, there is no provision of a structure for ensuring a constant quantity of abrasive is finally supplied to the abrasive conduit 44.

With the above described structures of the related art also, in order to prevent insufficient abrasive entering the grooves 47 and the indented sections 49, it has been proposed to have a structure that subjects the abrasive tank 10 and the drum 50 to vibration to make it easy for abrasive to enter the grooves 47 or the like and makes it possible for surplus abrasive that is overflowing from the grooves 47 or the like to be shaken off (in '864 cited above), but in the event that the abrasive tank 10 is vibrated in this way, bridges where the abrasive has compacted may occur inside the abrasive tank 10, which adversely lowers fluidity.

When abrasive is shaken out, it has once entered in the grooves 47 by the vibration of the abrasive tank 10 and drum 50 in this way, and constant supplying performance cannot necessarily be guaranteed even by applying vibration in this way.

Further, with the apparatus for supplying a constant quantity of abrasive 1 of the related art configured as described above, in order to prevent pressure inside the abrasive conduit 44 and the conduit for compressed air 46 from leaking to the inside of the abrasive tank 10, a slider 48 provided at an opening end edge of the abrasive conduit 44 is brought into sliding contact with the outer periphery of the drum 50, causing severe abrasion on the drum 50 and the slider 48, making frequent replacement necessary, and in particular since a boron member which is comparatively expensive is used as the slider running costs increase.

Further, if the abrasive that is the subject of supplying is left in a state where a large quantity of abrasive is collected and placed inside the tank 10, there may be instances where bridges occur and dry out as time elapses, and if bridges occur in this way, fluidity will be significantly impaired.

It therefore becomes difficult for the abrasive to enter into the grooves 47 and indented sections 49 because of the occurrence of bridges, accurate measurement of the abrasive becomes extremely difficult, and as a result, fluctuation arises in the quantity of abrasive supplied to the blast gun.

In particular, in the case where an elastic abrasive constituted by an elastic base material that is a dispersed mixture of abrasive formed to a specified grain diameter, or an elastic abrasive constituted by evenly supporting abrasive by fixing on the surface of an elastic base material formed to a specified grain diameter, is used as the abrasive, then it causes bridges to arise with this type of elastic material compared to the normal abrasive, and as a result, if blast processing is started or restarted after abrasive has been left inside the tank for a comparatively long time without being made to flow, then in the initial stages of starting or restarting the blast processing, the supplying quantity of abrasive is not constant and is unstable.

Fluidity varies with variation in the grain diameter of the abrasive, and as a result, in the event that the grain diameter of the abrasive is small and fluidity is comparatively good, there is an increase in the quantity of abrasive that is conveyed to the inside of the abrasive tank 10, and the level of abrasive inside the abrasive tank 10 becomes high. On the other hand, in order to prevent this as much as possible, a vibrator (not shown) for applying vibration to the known abrasive tank and a non-shown recovery tank is attached, and control of the vibrator is carried out to the recovery tank, but this is extremely difficult, and reduces fluidity, and lowers the supply level of abrasive in the abrasive tank 10. Further, a bridge phenomenon occurs in the branched conduit 42 and/or the abrasive conduit 44 blocking up corresponding parts, and a phenomenon arises where a supply level of abrasive becomes extremely unstable.

In the case of an apparatus for supplying a constant quantity of abrasive of the related art provided with a drum which is arranged not completely immersed within the abrasive, but in a state with partially exposed from the abrasive, if there is a fluctuation in the quantity of abrasive in the abrasive tank 10 in this way, there will be variations in the immersed state of the drum or the like, and variations in how the abrasive enters the grooves 47 accompanying variations in the quantity of abrasive in the abrasive tank, and if, for example, the drum is immersed at a comparatively deep position and the abrasive is evenly spread even at the periphery of the grooves 47, so that this type of spread abrasive increases the quantity of abrasive to be supplied together with abrasive inside the grooves 47, then accompanying variation in the grain diameter of abrasive that is the subject of supplying, variation in supplied abrasive quantity will arise.

Therefore, with an apparatus for supplying a constant quantity of abrasive of the related art provided with the above described structure, it is even necessary to give consideration to the particle diameter of abrasive used in order to accurately control overall quantity of abrasive to be supplied, and complicated control is required.

The present invention is made in view of the drawbacks above described related art, and an object of the present invention is to provide an apparatus for supplying a constant quantity of abrasive for a blasting machine that can make it easy to supply abrasive to hole sections and also make it easy to extract the abrasive from inside the hole sections, to thereby prevent fluctuation in the quantity of abrasive inside the hole sections during supplying to an abrasive conduit 44, thus enable accurate supplying of measured quantity of abrasive, and that can perform supplying a constant quantity of abrasive, and maintaining good fluidity even in the event that an abrasive that is prone to bridges, for example the previously described elastic abrasive, is used, and can supply a constant quantity of abrasive without being affected by fluctuation in the quantity of abrasive inside an abrasive tank accompanying fluctuation in the particle diameter of the abrasive in question.

SUMMARY OF THE INVENTION

In the following explanation of the Summary, reference numerals are referred as said in the Embodiment in order to easily read the present invention, however, these numerals are not intended to restrict the invention as of the Embodiment.

In order to achieve the above-described object, an apparatus for supplying a constant quantity of abrasive 1 of the present invention for supplying a constant quantity of abrasive to blast guns 40, 40', in a blasting machine for ejecting a mixed fluid of a compressed fluid and the abrasive from the blast guns 40, 40', comprises:

an abrasive tank 10 for storing abrasive, and in the abrasive tank 10 further provided, an abrasive supplying conduit 14 for conveying the abrasive, a rotating disk 20 horizontally rotating at a specified speed at a position where the rotating disk 20 is immersed in the abrasive stored inside the abrasive tank 10, and a flow path 2 having a gap 3 being capable to rotate the rotating disk 20 in a state where the rotating disk is airtight, wherein the flow path 2 being consisted of a gas flow path 12 and a mixed fluid flow path 11, the gas flow path 12 being provided in the abrasive tank 10 and isolated in an airtight state, the gas flow path 12 supplies gas, the gas being compressed air or external air, the mixed fluid flow path 11 is communicated with the gas flow path 12 at each end 11*a*, 12*a* (hereinafter referred to as "the other end 11*a*" and "the other end 12*a*", respectively), and supplies a gas for supplying abrasive, and mixed fluid of the abrasive, to a blast gun, and the rotating disk 20 is provided with a plurality of hole sections 21 and stirring blades 22, and wherein the plurality of hole sections 21 are formed, the hole sections being passed through the rotating disk 20 in a thickness direction, at equal intervals in the circumferential direction corresponding to a rotational locus through which the gap 3 being capable to rotate the rotating disk 20 passes in the flow path 2, and a plurality of the hole sections 21 are formed having the same diameter, that is, if the hole sections are cylindrical, they are hole sections of the same diameter, with spaces demarcating the hole sections respectively having the same volume, in a line or plurality lines (in a concentric pattern), and a plurality of the stirring blades 22 are preferably provided, with, for example, rectangular plate bodies, or cylindrical bodies with a circular cross section, or rod shaped bodies, protruding above the rotating disk 20 at equal intervals in a circumferential direction of the rotating disk 20.

In the case where the blasting machine is a suction type blasting machine, one of the two ends (hereinafter referred to as "one end 12*b*") of the gas flow path 12 constituting the flow path 2 preferably opens outside the abrasive tank 10.

Also, in the case where the blasting machine is a direct pressure type blasting machine, the one end 12*b* of the gas flow path 12 communicates with a supply source of compressed gas, for example, a compressed air supply source (not shown).

Communication between the compressed air supply source (not shown) and the gas flow path 12 may be obtained by directly communicating the one end 12*b* of the gas flow path 12 with a compressed air supply source such as an air compressor, but as shown in the illustrated embodiment, it is also possible to communicate with a compressed air supply source, making it possible to make the abrasive tank 10 airtight, and at the same time cause the one end 12*b* of the gas flow passage 12 to be opened inside the abrasive tank 10 at a position that is higher than an upper limit of a filling position of the abrasive to communicate the one end 12*b* of the gas flow path 12 with the compressed air supply source via a storing space 13 of the abrasive tank 10.

It is also possible to provide flanges 11*c* and 12*c* having a gap 3 being capable to rotate the rotating disk 20 in an airtight state, at the other end 11*a* of the mixed fluid flow path 11 and at the other end 12*a* of the gas flow path 12.

According to the apparatus for supplying a constant quantity of abrasive 1 of the present invention, a rotating disk 20 having hole sections 21 is caused to rotate at a constant speed, and by supplying abrasive that has been filled the hole sections 21 is continuously supplied to a mixed fluid path 11, thereby it is possible to eject a predetermined or measured quantity of abrasive from a blast gun 40.

In particular, it is made easy for abrasive to enter into the hole sections 21 by having the hole sections 21 formed in the rotating disk 20 pass through the disk in a vertical direction, and also the hole sections 21 formed in the rotating disk 20 that is itself comparatively thin are comparatively shallow, so it is even easier for abrasive to enter the hole sections 21.

Further, the rotating disk 20 is immersed in the abrasive, except for inside the gap 3 being capable to rotate the rotating disk 20 that makes rotating and sliding contact with the other end 11*a* of the mixed fluid path 11 constituting the flow path 2 and the other end 12*a* of the gas flow path 12, thereby the inside of the hole sections 21 is always filled with abrasive, in addition, the quantity of abrasive collected inside the hole sections does not fluctuate even with rotation of the rotating disk 20. As a result, it is possible to always supply a constant quantity of abrasive to the mixed fluid flow path.

In addition, when the hole sections 21 are moved into the gap 3 being capable to rotate the rotating disk 20 between the other end 11*a* of the mixed fluid path 11 constituting the flow path 2 and the other end 12*a* of the gas flow path 12 with rotation of the rotating disk 20, abrasive that is not stored inside the hole sections 21 is removed by being dropped off by the gap 3 being capable to rotate the rotating disk 20, that is, an opening edge of the mixed fluid flow path 11 and the opening edge of the gas flow path 12, thus abrasive supplied to the mixed fluid flow path 11 can be measured extremely accurately.

Also, the present invention is inexpensive compared to the structure described in the related art where a slider made of boron or the like makes sliding contact, thus making it possible to reduce running costs.

The stirrer blade 22 protruding upwards is provided on the upper surface of the rotating disk 20 thereby stirring and loosening abrasive above the rotating disk 20 with this stirrer blade 22, thus it is possible to achieve fluidity even if bridges are occurred and set on the abrasive, accordingly, it is possible for the abrasive to drop downwards and to flow appropriately into the hole sections 21 provided in the rotating disk 20.

Since it is possible to accurately measure abrasive quantity supplied to the mixed fluid flow path 11 in this manner, it is possible to obtain an ejecting quantity for the abrasive that is closer to a theoretical value compared to the apparatus for supplying a constant quantity of abrasive 1 described as the related art, and it is easy to control a quantity of abrasive to be supplied.

Because the rotating disk 20 is completely immersed in the abrasive inside the abrasive tank 10, then even if the quantity of abrasive inside the abrasive tank 10 is reduced or increased due to variation in fluidity accompanied with variation in the particle diameter of the abrasive used, it is possible to provide an apparatus for supplying a constant quantity of abrasive where a quantity of abrasive to be supplied does not vary due to the quantity of abrasive inside the abrasive tank 10 varying in this way.

With a structure where flanges 11*c* and 12*c* are provided on peripheral edges of the other end 11*a* of the mixed fluid flow path 11 constituting the flow path 2 and the other end 12*a* of the gas flow path 12, then even in a case where the hole diameter of the hole sections 21 is larger than the thickness of a wall defining the mixed fluid flow path 11 and the gas flow path 12 (in the case of the mixed fluid flow path 11 and the gas flow path 12 being formed by a flow path, for example, the thickness of the conduit), it is possible to appropriately prevent the mixed fluid flow path 11 from being communicated with the storing space 13 inside the abrasive tank 10 by way of the hole sections 21, thus leaking out the abrasive.

BRIEF DESCRIPTION OF THE DRAWINGS

The objects and advantages of the invention will become apparent from the following detailed description of preferred embodiments thereof provided in connection with the accompanying drawings in which.

DETAILED DESCRIPTION OF THE PREFERRED EMBODIMENTS

Embodiments of the present invention will be described in the following with reference to the attached drawings.

An Apparatus For Supplying a Constant Quantity Of Abrasive for Suction

Type Blasting Machine

Overall Structure

Figure 1:
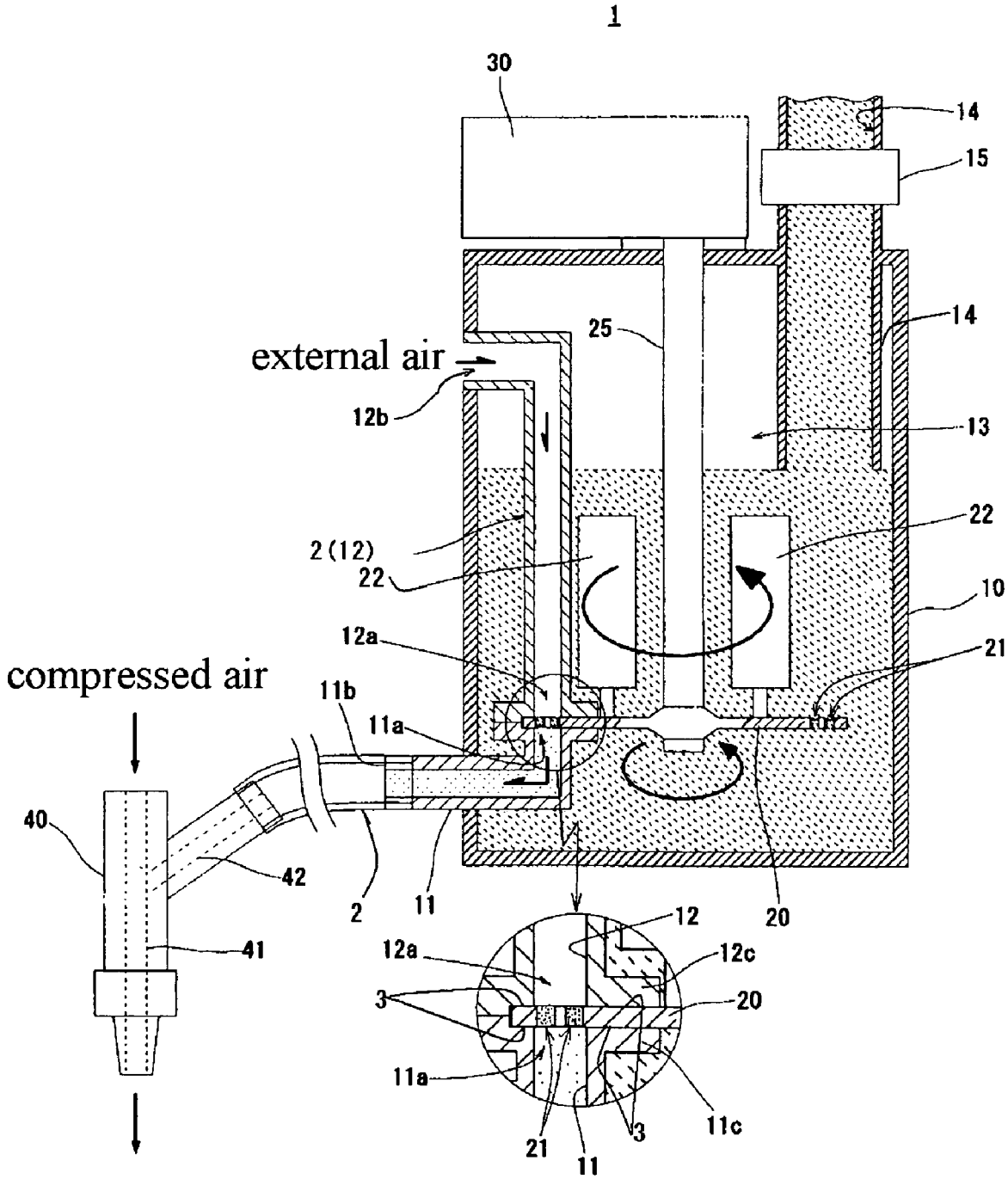
FIG. 1 is a partial cross section showing an embodiment of an apparatus for supplying a constant quantity of abrasive of the present invention (adapted to a suction type blasting machine)

An apparatus for supplying a constant quantity of abrasive of the present invention applied to a suction type blasting machine is shown in FIG. 1.

This apparatus for supplying a constant quantity of abrasive 1 is provided with an abrasive tank 10 storing abrasive, an abrasive supplying conduit 14 for carrying the abrasive into the abrasive tank 10, a flow path 2 for making a mixed fluid of the abrasive in the abrasive tank 10 and a compressed fluid such as compressed air for supply to a blast gun, and a rotating disk 20 for measuring the abrasive and supplying a constant quantity of the abrasive at a time to a mixed fluid flow path 11 of the flow path 2. The mixed fluid flow path 11 of the flow path 2 is provided in the tank 10 and communicated with a gas flow path 12 that is supplied with outside air or compressed fluid, to define the inside of the tank 10 and isolated in an airtight state. Also, the rotating disk 20 rotates horizontally at a specified speed inside the abrasive tank 10, with a gap 3 being capable to rotate the rotating disk 20 formed in the flow path 2 with the rotating disk in an airtight state.

With the illustrated embodiment, the flow path 2 is provided as an independent conduit at a position separated from an inner wall of the abrasive tank 10, but it is also possible to have a structure where the inner wall of the abrasive tank 10 is made as an inner wall of the conduit, and other inner wall is provided so as to close up this inner wall. In this case, the diameter of the rotating disk of the illustrated embodiment will become larger.

Rotating Disk

The rotating disk 20 is provided so as to be able to rotate in the horizontal direction inside the abrasive tank 10, which will be described later, with cylindrical hole sections having the same diameter being arranged in the rotating disk 20, at specified intervals in the circumferential direction, and passing through in a thickness direction of the rotating disk 20, although this is not limiting, and hole sections 21 for measuring supplied abrasive are formed.

Specifically, by forming each hole section 21 to have the same volume in this way, it is possible to collect the same quantity of abrasive inside each hole section 21, and supplying the abrasive that has collected in each hole section 21 to the mixed fluid flow path 11 at a constant speed by making the rotational speed of the rotating disk 20 constant, a quantity of abrasive conveyed/supplied to the blast gun 40 at a specified pressure is made constant.

In the embodiment shown in FIG. 1, the hole sections 21 are arranged forming a double line in a concentric fashion, but it is also possible to have a single line of hole sections 21, or three lines, or an even greater numbers of lines.

A rotation shaft 25 that passes from outside the abrasive tank 10 through a top panel section (or alternatively a bottom panel section) of the abrasive tank 10 and is inserted inside, is attached at the center of the rotating disk 20 formed as described above, and it is possible to rotate at a specified speed in a horizontal direction inside the abrasive tank 10 in accordance with rotation of the rotating shaft 25 that is rotated by rotation means such as an electric motor 30, that will be described later.

Also, stirring blades 22 protruding vertically, that is upwards, from the rotating disk 20 are formed on an upper surface of the rotating disk 20, and it is possible to stir the abrasive, which is above the rotating disk, at the time of rotation of the rotating disk 20 using these stirrer blades 22.

In the illustrated embodiment, the stirrer blades 22 are formed as rectangular plates, but as long as the abrasive above the rotating disk 20 is stirred, the stirrer blades 22 are not limited to a rectangular shape, and can be, for example, solid rod-shaped cylindrical bodies, or other shape. It is possible to make the stirrer blades 22 as rod-shaped bodies, and fasten them to the rotation shaft 25 in a direction orthogonal to the shaft 25, so that similarly to the stirrer blades 22 provided on the rotating disk 20, the stirrer blades rotate in a horizontal direction above the rotating disk 20.

In the illustrated embodiment, a total number of two stirrer blades are arranged at symmetrical positions spaced 180° apart, but it is also possible for the stirrer blades 22 to be arranged at a single position, or at three or more positions. It is also possible for the arrangement of the stirrer blades to be such that they are inclined at a specified angle, for example 90° or less, with respect to the rotation direction of the rotating disk 20.

Abrasive Tank

The abrasive tank 10 houses the rotating disk 20 so as to be capable of rotating, and is also internally provided with a storing space 13 for storing abrasive to be supplied to a blast gun.

A mixed fluid flow path 11 that is communicated with the blast gun, that will be described later, is arranged in the storing space 13 inside the abrasive tank 10, at a position that does not interfere with the stirrer blades 22 provided on the rotating disk 20, and the other end 11*a* of this mixed fluid flow path is arranged facing the hole sections 21 with a gap 3 being capable to rotate the rotating disk 20, with respect to the rotating disk 20.

The other end 12*a* of a gas flow passage 12 is arranged at a surface of the rotating disk 20 (the upper surface in the illustrated example) that is opposite to the surface where the other end 11*a* of the mixed fluid flow path 11 is arranged (the lower surface of the rotating disk 20 with the illustrated example), so as to be symmetrical with the other end 11*a* of the mixed fluid flow path 11 through the rotating disk 20, and in this way, the gap 3 being capable to rotate the rotating disk 20 is formed between the other end 11*a* of the mixed fluid flow path 11 and the other end 12*a* of the gas flow path, in a state of which the rotating disk 20 is positioned between the other ends 11*a*, 12*a*.

The one end 12*b* of the gas flow passage 12 is opened at a position allowing air to be supplied when the inside of the mixed fluid flow path 11 becomes negative pressure, and with this embodiment, it is opened at an outside of the abrasive tank 10.

The one end 12*b* of the gas flow path 12 may be opened at any position as long as it is possible to supply air into the gas flow passage 12, and is also possible, for example, to be opened inside the abrasive tank 10 higher up than the uppermost abrasive filling position.

Flanges 11*c* and 12*c* are provided on the peripheral edge of the other end 11*a* of the mixed fluid flow path 11 and the peripheral edge of the other end 12*a* of the gas flow path 12, protruding outwardly over the respective peripheral edges, and these flanges 11*c* and 12*c* form the respective gap 3 being capable to rotate the rotating disk 20 at the two surfaces of the rotating disk 20.

The flange sections 11*c* and 12*c* are particularly effective when the diameter of the hole sections 21 formed in the rotating disk 20 is large with respect to the thickness of the wall surface defining the mixed fluid flow path 11 and gas flow path 12, and when the hole sections 21 pass between the thickness of the mixed fluid flow path 11 and the thickness of the gas flow path 12, direct communication of the mixed fluid flow path 11 with the space inside the abrasive tank 10 via the hole sections 21 is prevented, and abrasive forced out from the upper and lower openings of the hole sections 21 provided in the rotating disk 20 is removed to supply accurately measured abrasive to the gap 3 being capable to rotate the rotating disk 20 between the mixed fluid flow path 11 and the gas flow path 12.

In the illustrated embodiment, the flange 11*c* provided on the other end 11*a* of the mixed fluid flow path 11 and the flange 12*c* provided on the other end 12*a* of the gas flow path 12 are communicated at an outer circumference side of the rotating disk 20, with the gap 3 being capable to rotate the rotating disk 20 being provided forming an open-ended rectangle shape in cross section, but it is also possible to have a structure where the two flanges 11*c* and 12*c* are not communicated and are vertically separated.

In FIG. 1, reference numeral 14 is an abrasive supplying conduit for supplying abrasive to the abrasive tank 10, and is constructed so that, for example, it is communicated to a lower end of recovery tank (not shown) for recovering abrasive that has been ejected from the blast gun 40, and it is possible to convey abrasive that has been collected in the recovery tank to the abrasive tank 10 by opening and closing a valve 15 provided in the abrasive supplying conduit 14.

Abrasive in a quantity that always completely covers the rotating disk 20 including the stirrer blades 22, is stored inside the abrasive tank 10, and preferably, a constant quantity of abrasive is always stored.

In order to make the quantity of abrasive inside the abrasive tank 10 always constant, in this embodiment, the lower end of the abrasive supplying conduit 14 protrudes into the abrasive tank 10, and is arranged at the upper limit of the abrasive filling position.

By having such a structure, if the valve 15 is opened to convey abrasive to the abrasive tank 10 and the abrasive is stored up to the position of the lower end of the abrasive supplying conduit 14, the dropping of abrasive is stopped without operating the valve 15. Accordingly, during operation of the apparatus for supplying a constant quantity of abrasive 1 of the present invention, by keeping the valve 15 in an open state, if abrasive is supplied to the blasting machine and the uppermost position of the stored abrasive drops, abrasive equivalent to the dropped quantity thereof is conveyed via the abrasive supplying conduit 14 and it is possible to always maintain the abrasive inside the abrasive tank 10 at a constant quantity.

As a structure for making the quantity of abrasive inside the abrasive tank 10 constant, it is possible, without extending the lower end of the abrasive supplying conduit 14 as in the illustrated example, to provide a sensor for detecting the uppermost position of abrasive stored inside the storing space in the abrasive tank 10, for example, and control the opening and closing operation of the valve 15 in accordance with a detection result from this sensor.

Rotation Mean (Electric Motor)

Rotation means for rotating the rotating disk 20 is an electric motor 30 arranged on the abrasive tank 10 in this embodiment. An upper end of a rotating shaft 25 that is provided passing through the top panel of the abrasive tank 10 communicates with this electric motor 30, and by communicating the lower end of the rotating shaft 25 with the rotating disk 20, it is possible to cause the rotating disk 20 inside the abrasive tank 10 to rotate with rotation of the electric motor 30.

Provided it is possible to control rotational speed of the rotating disk 20, various types of motors can be used as this electric motor 30. For example, it is possible to use a direct current motor and make rotational speed variable by varying an input voltage, or alternatively to use a three-phase alternating current motor, and control rotational speed by making the frequency of current input variable using an inverter.

By controlling the rotational speed of the electric motor 30 in this way, it is possible to accurately control a quantity of abrasive supplied to the blast gun 40 by controlling rotational speed of the rotating disk 20 to vary the number of hole sections 21 passing through the gap 3 being capable to rotate the rotating disk 20 between the other end 11*a* of the mixed fluid flow path 11 and the other end 12*a* of the gas flow path 12 in a specified time.

Usage Method and Operation

The apparatus for supplying a constant quantity of abrasive 1 of the present invention constructed as described above is used by converging one of two ends (hereinafter referred to as "one end 11*b*") of the mixed fluid flow path 11 with a compressed air flow path in which high pressure compressed air flows.

In the embodiment shown in FIG. 1, a blast gun 40 provided internally with a compressed fluid flow path 41 and a branched conduit 42 that branches from the compressed fluid flow path 41 is used, and the one end 11*b* of the mixed fluid path 11 is communicated with the branched conduit 42 of the blast gun 40.

The electric motor 30 is preferably configured so as to rotate at a set rotational speed only at the time of supplying compressed air to the blast gun 40, and in this way when not performing ejection of abrasive, the rotating disk 20 is rotated, abrasive inside the mixed fluid flow path 11 drops off and is collected, and it is possible to prevent ejecting of the whole quantity of abrasive at the time of commencing a blast operation.

As described above, in a state where the one 11*b* of the mixed fluid flow path 11 of the apparatus for supplying a constant quantity of abrasive 1 according to the present invention is communicated with the branched conduit 42 of the blast gun 40, if the compressed air is supplied from a compressed air supply source, not shown, using the rear end of the blast gun 40, air that has been sucked in the mixed fluid flow path 11 via the branched conduit 42 by this supply of compressed air, and supplied using the gas flow path 12 having the one end 12*b* opening outside the abrasive tank 10, passes through hole sections 21 formed in the rotating disk 20 that are positioned in the gap 3 being capable to rotate the rotating disk 20 between the other end 11*a* of the mixed fluid flow path 11 and the other end 12*a* of the gas flow path 12.

Abrasive that has collected inside the hole sections 21 is supplied using the air flow passing through the hole sections 21 and supplied to the inside of the mixed fluid flow path 11, converged with compressed air from the compressed air supply source inside the compressed fluid flow path 41 provided inside the blast gun 40, and ejected from the tip of the blast gun 40.

The rotating disk 20 is provided capable of rotation in the horizontal direction inside the abrasive tank 10, and is also provided with hole sections 21 passing vertically through in the thickness direction of the rotating disk 20, which means that abrasive flows smoothly into the hole sections 21.

Also, since abrasive that flows in the hole sections 21 and exists on the upper surface of the rotating disk 20 is stirred by the stirrer blades 22 protruding upwards from the upper surface of the rotating disk 20, even in the event of bridges occurring and being set in the abrasive, it is loosened by stirring with the stirrer blades 22 and it is possible for the abrasive to flow appropriately into the hole sections 21.

Further, the rotating disk 20 is immersed in abrasive stored inside the storing space 13 of the abrasive tank 10, except for parts positioned in the gap 3 being capable to rotate the rotating disk 20 between the other end 11*a* of the mixed fluid flow path 11 and the other end 12*a* of the gas flow path 12, which means that even if abrasive leaks out from an inside of the hole section 21 once it has flowed in to the hole sections 21 in the process of rotating the rotating disk 20 inside the abrasive, abrasive existing around the rotating disk 20 goes into the inside of the hole sections 21 to replenish the abrasive that has leaked out, and a constant quantity of abrasive is always filled into the hole sections 21.

Also, the rotating disk 20 that is immersed in the abrasive in this way differs from the apparatus for supplying a constant quantity of abrasive of the related art that is provided with a drum and a disk used in a partially exposed state and not completely immersed in the abrasive in that the quantity of abrasive supplied does not vary even with variation in the quantity of abrasive inside the abrasive tank 10.

In this manner, abrasive that has been collected inside the hole sections 21 of the rotating disk 20 is moved accompanying rotation of the rotating disk 20, surplus abrasive at the time of entry into the gap 3 being capable to rotate the rotating disk 20 between the other end 11*a* of the mixed fluid flow path 11 and the other end 12*a* of the gas flow path 12 is removed, and only a quantity of abrasive in accordance with the volume of the hole sections 21 is supplied to the inside of the gap 3 being capable to rotate the rotating disk 20.

Abrasive supplied in this way is sucked into the inside of the fluid flow path 11 together with air passing through the hole sections 21, which means that differing from the case of using the bottomed grooves or hole sections described as the related art, it is possible to supply the whole quantity of abrasive to the mixed fluid flow path 11 without leaving any abrasive inside the hole sections 21.

Accordingly, with respect to the abrasive ejected from the blast gun 40, a quantity accurately measured by the rotating disk 20 is supplied to the blast gun 40 and ejected.

In this manner, if the abrasive inside the abrasive tank 10 is ejected from the blast gun 40 and the quantity of abrasive stored inside the abrasive tank 10 is reduced, a quantity of abrasive corresponding to the extent of reduction is conveyed via the abrasive supplying conduit 14 to the abrasive tank 10, and the abrasive inside the abrasive tank 10 is controlled to always be a constant quantity.

Therefore, as a result of variation in weight of abrasive stored inside the abrasive tank 10, the density (clogged state between each particle) of stored abrasive is also constant, and the occurrence of variations in abrasive supply quantity accompanying these types of variations in density is also prevented.

Figure 2:
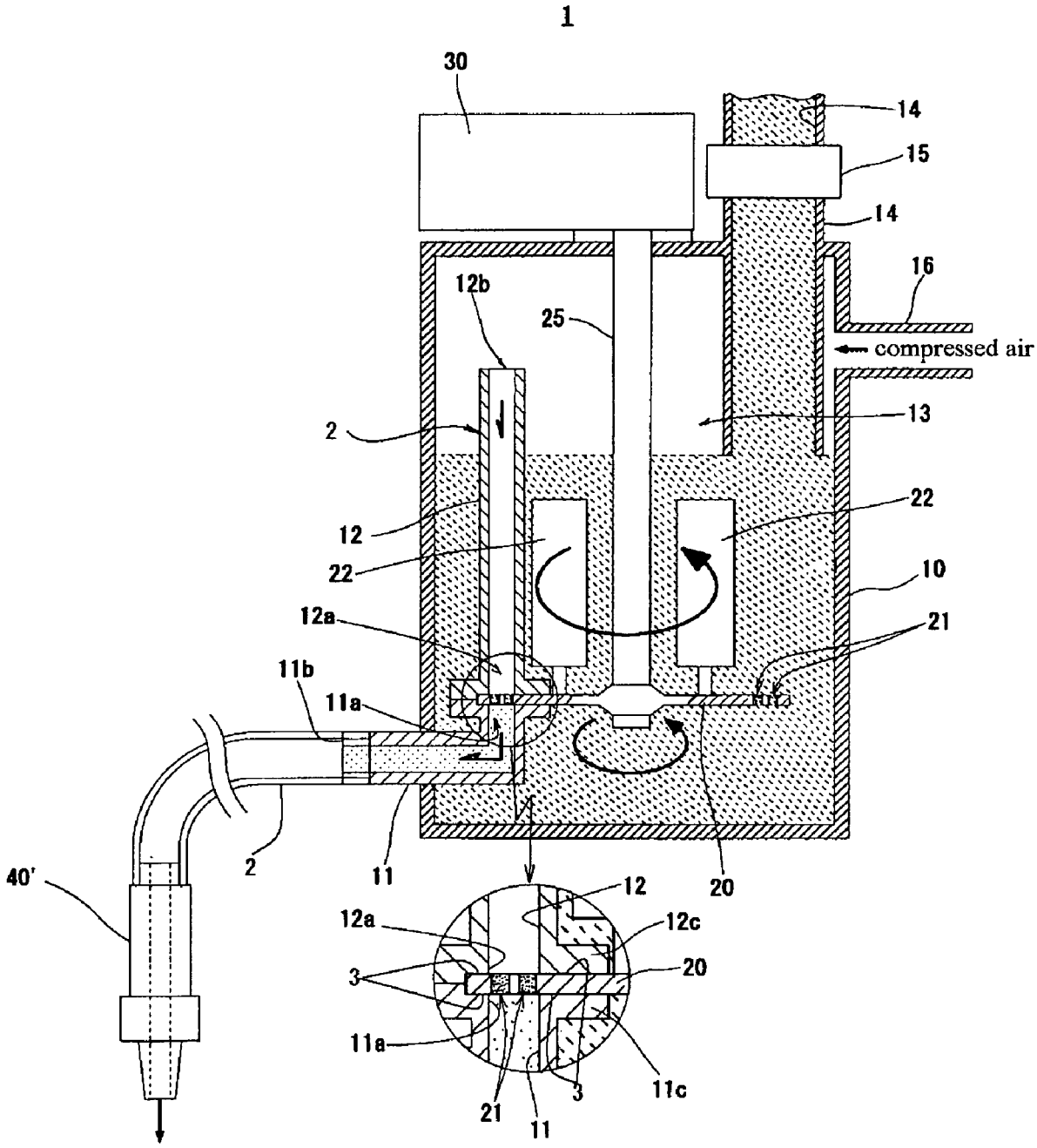
FIG. 2 is a partial cross section showing an embodiment of the present invention (adapted to a direct pressure type blasting machine)

An Apparatus For Supplying a Constant Quantity of Abrasive For Direct Pressure Type Blasting Machine Next, an apparatus for supplying a constant quantity of abrasive of the present invention used in a direct pressure type blasting machine will be described with reference to FIG. 2.

With the apparatus for supplying a constant quantity of abrasive 1 for a suction type blasting machine described with reference to FIG. 1, the mixed fluid flow path 11 communicated with the branched conduit 42 is sucked by negative pressure inside the branched conduit 42 arising when compressed air is supplied into the compressed fluid flow path 41 provided in the blast gun 40, and abrasive inside the hole sections 21 facing the other end 11*a* of the mixed fluid flow path 11 is thus sucked up and can be supplied to the blast gun 40, but in this embodiment, compressed air is blown into the hole sections 21 from a surface of the rotating disk 20 that is opposite to the surface faced by the other end 11*a* of the mixed fluid flow path 11, and abrasive inside the hole sections 21 is supplied to the blast gun 40 by this compressed air.

In order to be able to supply compressed air to the mixed fluid flow path 11 in this manner, with this embodiment, the inside of the abrasive tank 10 is constructed cable of being made airtight, and a tank pressurizing conduit 16 for supplying compressed air is communicated with the inside of the abrasive tank 10.

With the apparatus for supplying a constant quantity of abrasive 1 described with reference to FIG. 1, the one end 12*b* of the fluid flow path 12 is opened outside the abrasive tank 10, but in this embodiment, the one end 12*b* of the fluid flow path 12 is opened inside the abrasive tank 10 higher up than the uppermost storing position of the abrasive, and compressed air that has been supplied into the abrasive tank 10 by way of the tank pressurizing conduit 16 can be blown into the hole sections 21 via the gas flow path 12.

The rest of the structure of this embodiment is the same as the structure of the apparatus for supplying a constant quantity of abrasive 1 described with reference to FIG. 1.

In the apparatus for supplying a constant quantity of abrasive 1 constructed as described above, the one end 11*b* of the mixed fluid flow path 11 is communicated with a blast gun 40' for a direct pressure type blasting machine.

The blast gun used in this direct pressure type blasting machine has a nozzle for ejecting a mixed fluid of compressed air supplied from a rear end and the abrasive from a tip thereof, and compressed air containing abrasive that has been supplied via the mixed fluid flow path 11 is ejected via the blast gun 40'.

Compressed air that has been supplied to the gas flow path 12 is ejected from the other end 12*a* of the gas flow path 12 and blown from one end side inside the hole sections 21 provided in the rotating disk 20, and ejected from the other end side together with abrasive that has collected inside the hole sections 21 to be supplied via the other end 11*a* of the mixed fluid flow path 11 into the mixed fluid flow path 11. After that, abrasive is supplied together with compressed air to the ejecting nozzle 40' and ejected from the tip of the nozzle.

In this way, abrasive inside the hole sections 21 is ejected together with compressed air that is blown into the hole sections 21, which means that it is possible to supply the whole quantity of abrasive accurately to the blast gun 40' without leaving abrasive inside the hole sections 21.

Similarly to the apparatus for supplying a constant quantity of abrasive 1 applied to the suction type blasting machine described with reference to FIG. 1, it is possible to accurately control abrasive quantity supplied to the blast gun 40' by controlling the rotational speed of the rotating disk 20.

By making the system of the mixed fluid flow path 11 metering the abrasive and communicating with the gas flow path 12 of the flow path 2 up to the blast gun 40' of this embodiment into a pair of structures, and arranging the same structure as on the left side of the drawing for hole sections 21 on the right side in the drawing, it is possible to supply a constant quantity of abrasive to two blast guns.

Working Example

Next, results of comparative test carried out using an apparatus for supplying a constant quantity of abrasive (working example) of the present invention and the apparatus of the related art (comparative example) will be shown.

Test Conditions

Blasting Machine

A suction type blasting machine having compressed air pressure of 0.4 MPa was used as the blasting machine in both the working example and the comparative example.

Example of an Apparatus For Supplying a Constant Quantity of Abrasive

The apparatus for supplying a constant quantity of abrasive of the present invention has a disk diameter of 220 mm, a disk thickness of 1.5 mm, and hole sections of 5 mm diameter formed in the disk.

The hole sections are provided in a single row on the disk (a set of 80 on a circumference of 185 mm diameter), and an opening of the mixed fluid flow path has a diameter of 10 mm.

An Apparatus for Supplying a Constant Quantity of Abrasive Of Comparative Example The apparatus for supplying a constant quantity of abrasive of the related art, being the comparative example, has a drum diameter of 150 mm and a thickness of 30 mm, with grooves being provided on the outer periphery of the drum.

The size of the grooves is thickness 1 mm, depth 1 mm, and they are used provided in 20 rows.

Both apparatus for supplying a constant quantity of abrasives are provided with a three-phase alternating current motor as a rotation drive mechanism for the disk or the drum, and the motor rotation speed is variable by inverter control.

Test Method

Theoretical values for a quantity of abrasive to be ejected were respectively obtained from rotational speed and volume of each hole section provided in the rotating disk of the apparatus for supplying a constant quantity of abrasive of the working example, and the volume of each groove provided on the drum of the apparatus for supplying a constant quantity of abrasive of the comparative example, and compared with actual values.

Measurement was carried out by varying the frequency of current output from the inverter in a range of 20 Hz-60 Hz.

The abrasive used in the tests was #1000 WA (White Alundum) powder.

Test Results

Figure 3:
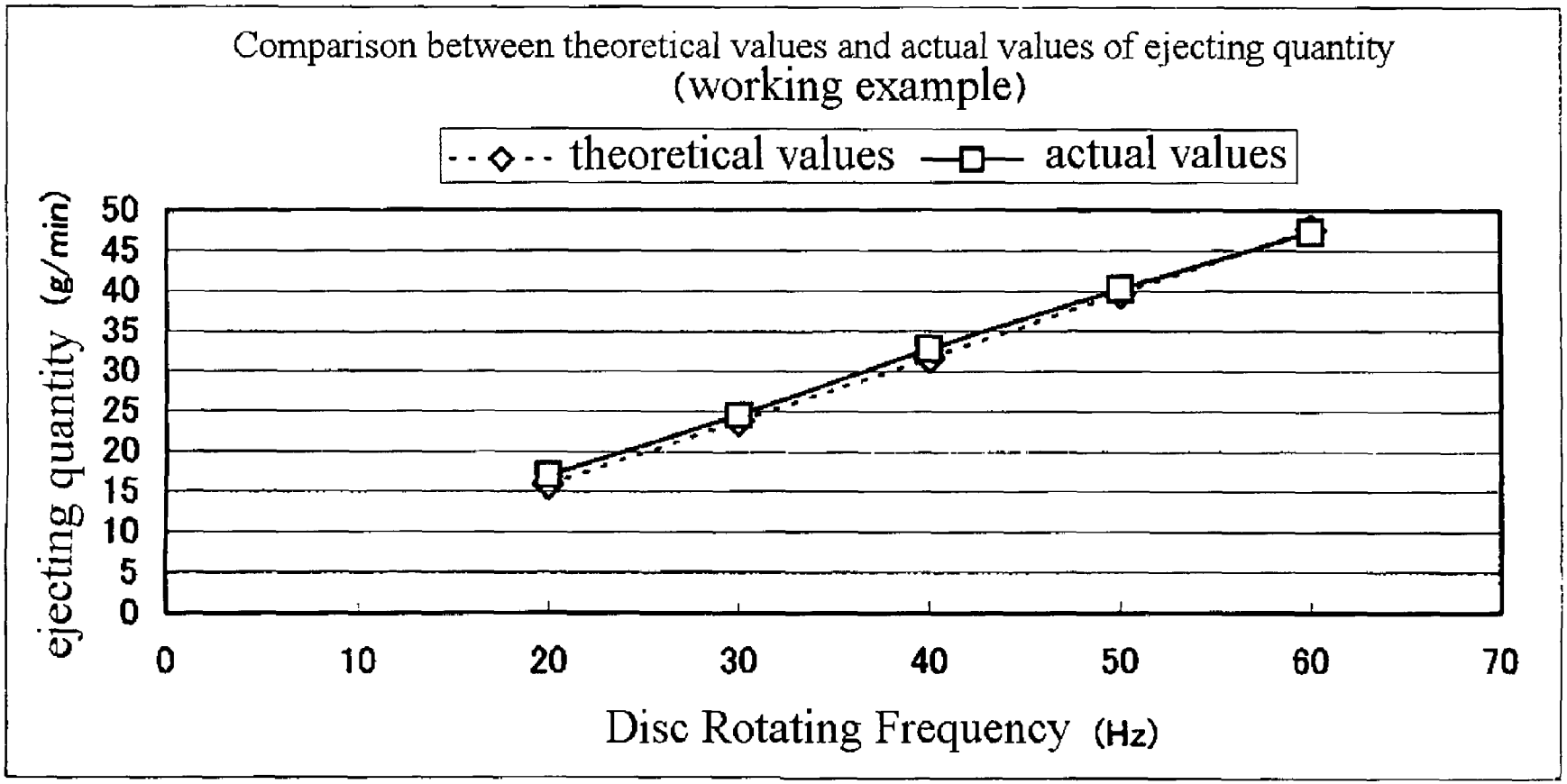
FIG. 3 is a graph showing abrasive ejecting quantity (theoretical values and actual values) of a working example of the present invention.
Figure 4:
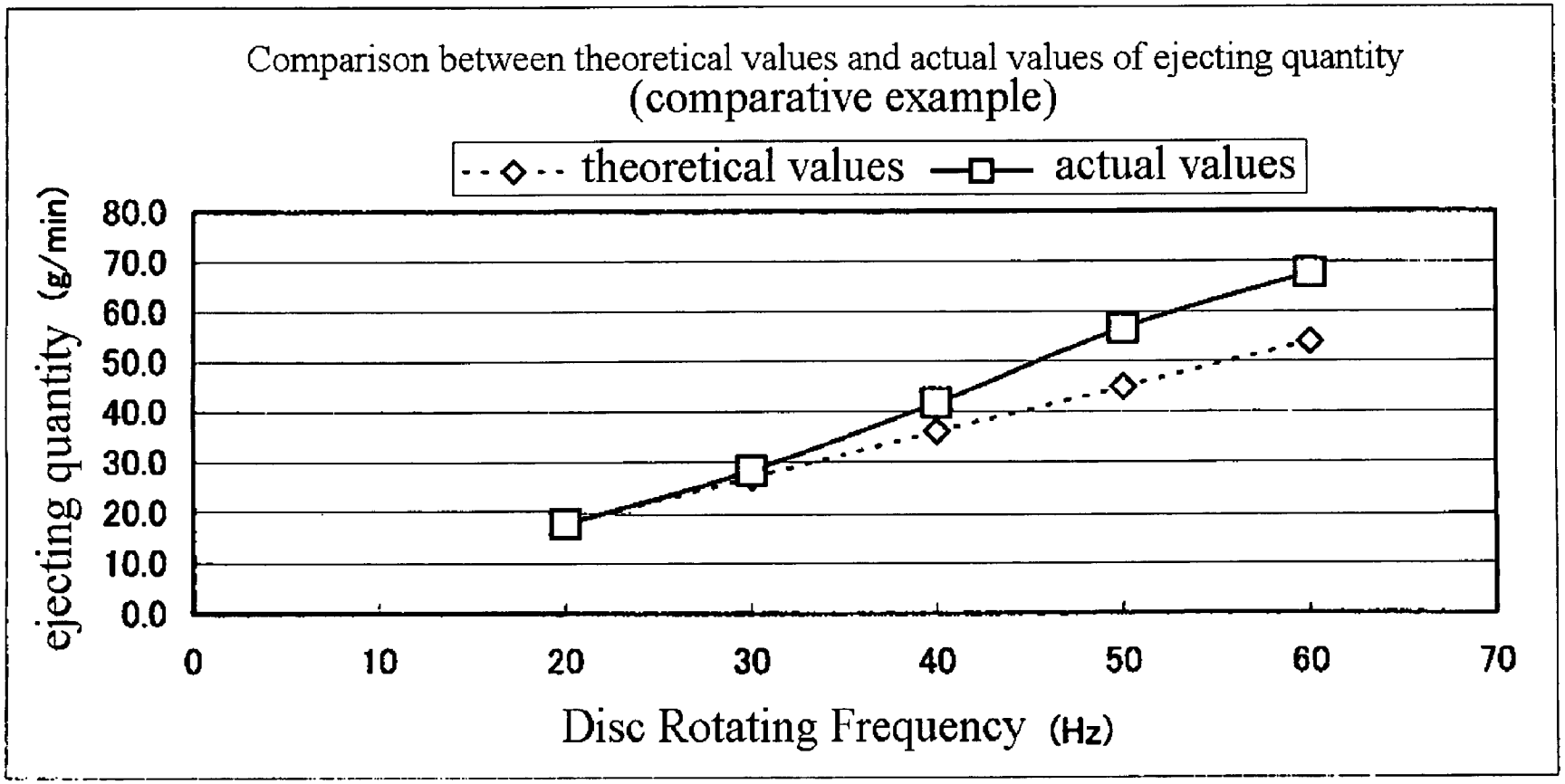
FIG. 4 is a graph showing abrasive ejecting quantity (theoretical values and actual values) of a comparative example.
Figure 5:
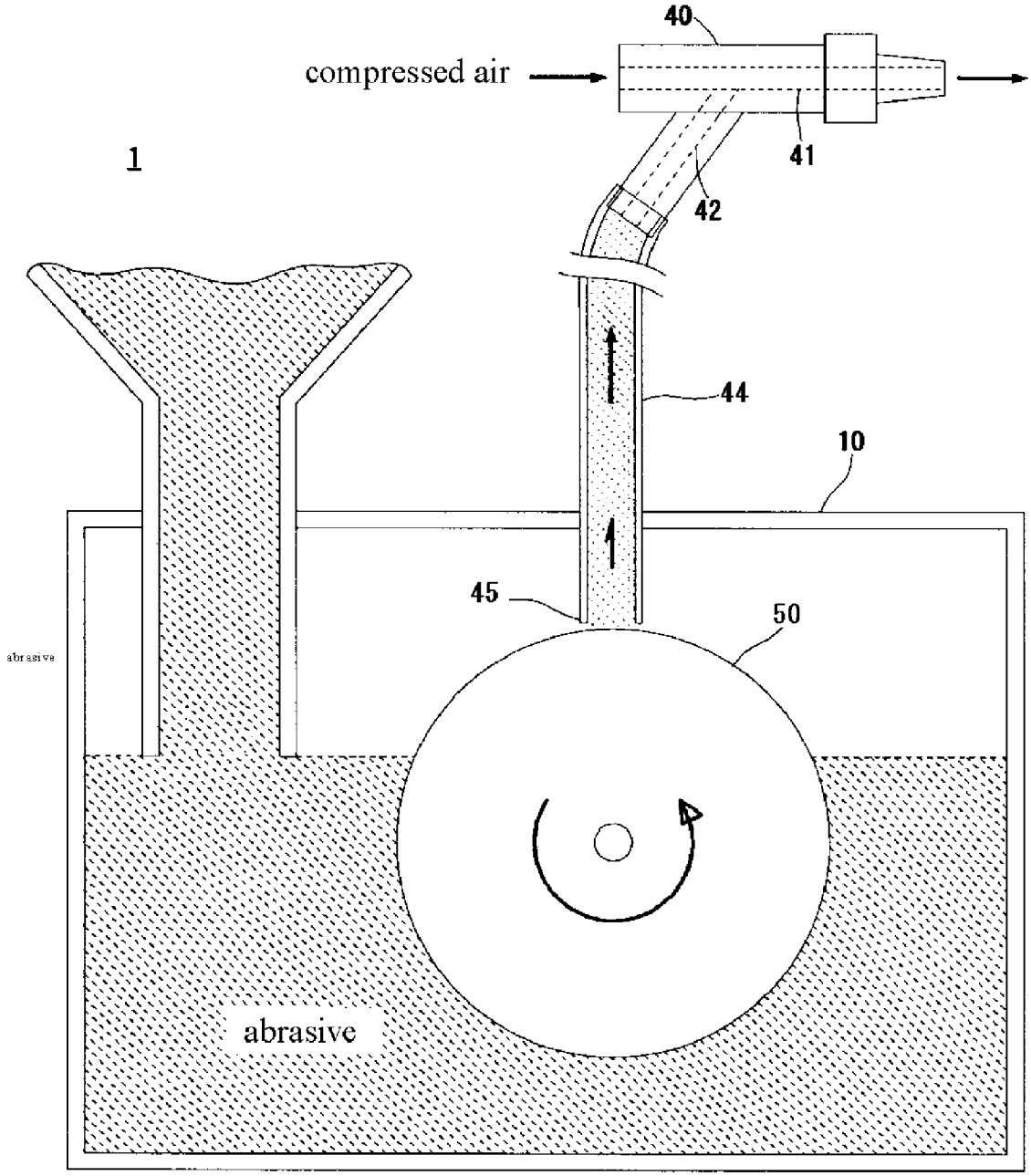
FIG. 5 is a schematic cross sectional view (front view) of an inside of an abrasive tank showing a related art apparatus (adapted to a suction type blasting machine)
Figure 6:
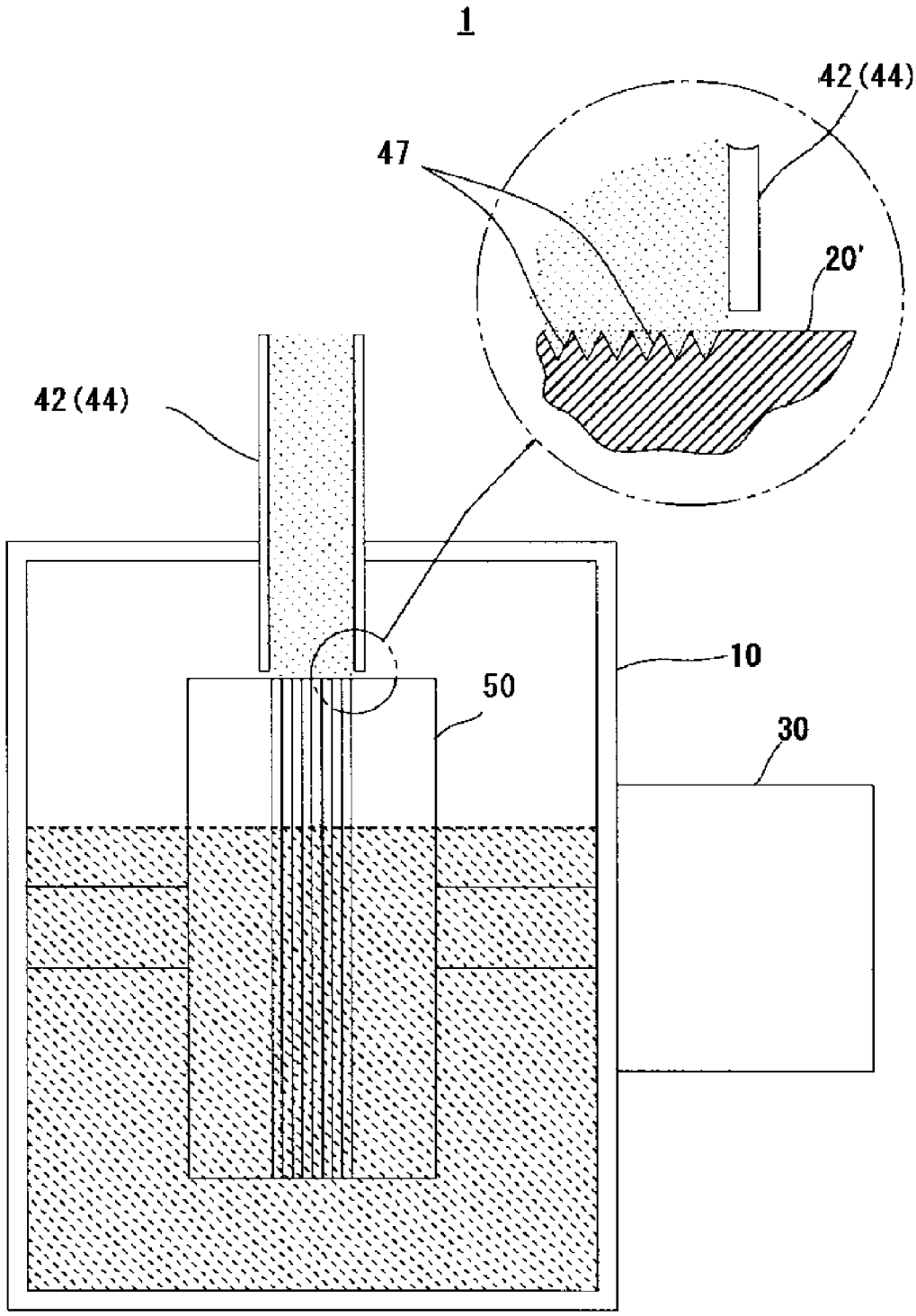
FIG. 6 is a right side view of FIG. 5.
Figure 7:
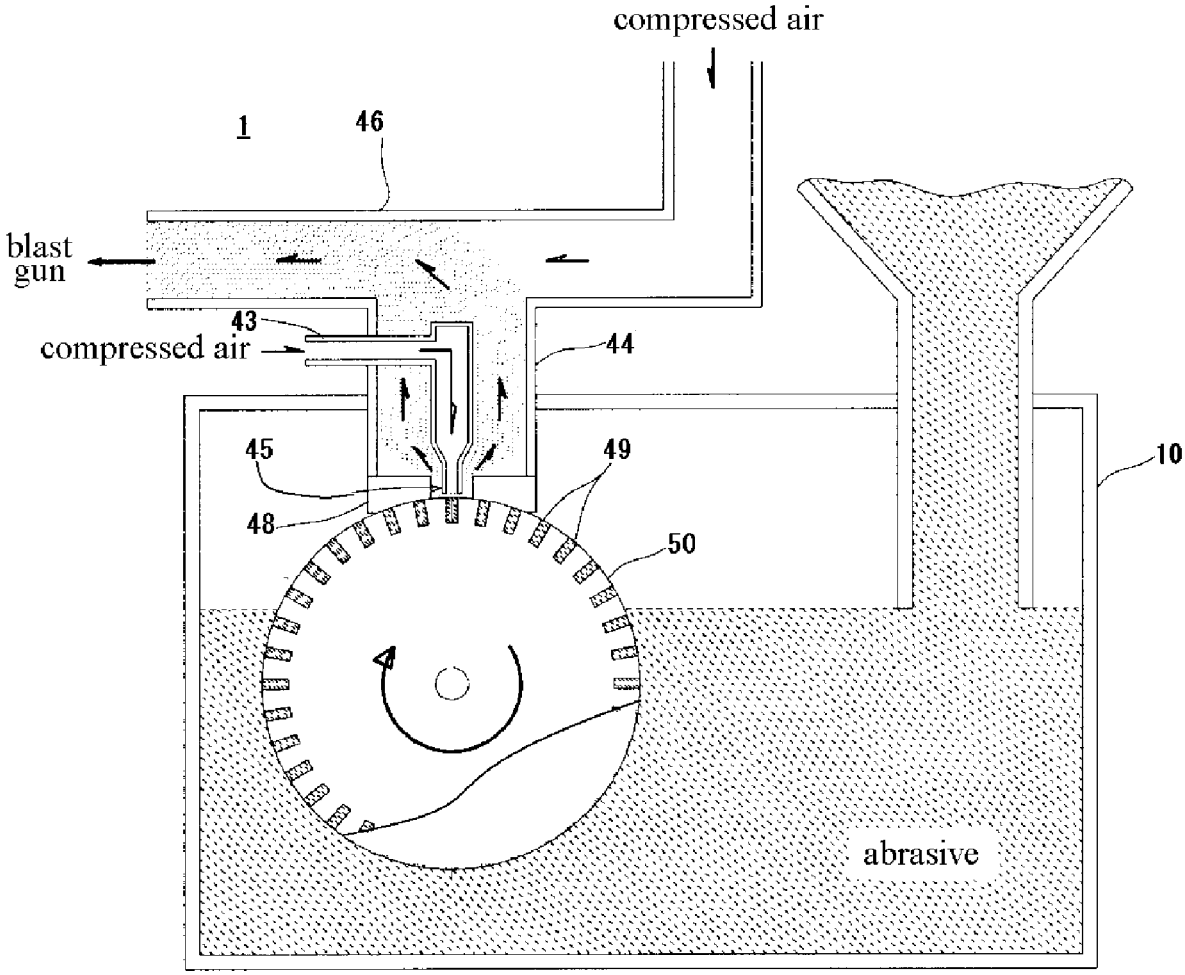
FIG. 7 is a schematic partially cutaway cross-section showing a related art apparatus (adapted to a direct pressure type blasting machine).

FIG. 3 is a graph showing theoretical values and actual values for a quantity of abrasive to be ejected for the case where the apparatus for supplying a constant quantity of abrasive of the working example was used, and FIG. 4 is a graph showing theoretical values and actual values for a quantity of abrasive to be ejected for the case where the apparatus for supplying a constant quantity of abrasive of the comparative example was used.

As will be clear from FIG. 3, according to the apparatus for supplying a constant quantity of abrasive of the working example, it was confirmed that it was possible to eject abrasive in a quantity of substantially equal to the theoretical values.

From this fact, in the apparatus for supplying a constant quantity of abrasive of the working example, there were no errors in the respective volumes of each formed hole section compared to the apparatus of the comparative example, and it is clear that in and out flow of abrasive to the hole sections is carried out smoothly, and it was confirmed that it was an apparatus for supplying a constant quantity of abrasive capable of more accurately controlling a quantity of abrasive to be ejected.

In the case of the test results where a comparative fine powder called #1000 was used as the abrasive, with the apparatus for supplying a constant quantity of abrasive of the comparative example results where the actual values were excessive compared to the theoretical values were obtained.

Specifically, when the used abrasive was the comparatively fine #1000 as described above, fluidity of the abrasive increased, with the result that a quantity of abrasive supplied into the abrasive tank increased, and not only abrasive in the grooves but also that attached around the grooves was sucked into the blast gun together with the abrasive in the grooves, which was considered to significantly increase the actual values of abrasive quantity compared to the theoretical values.

On the other hand, with the apparatus for supplying a constant quantity of abrasive of the working example, the same #100 abrasive was also used, and it was possible to supply abrasive in the same quantity as the theoretical values as described above, and it was possible to confirm that it was possible to carry out supply of abrasive without variations in fluidity accompanying variation in particle diameter of the abrasive that is to be supplied, and without being affected by variations in abrasive quantity inside an abrasive tank accompanying such fluidity variation.

Thus the broadest claims that follow are not directed to a machine that is configured in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described

What is claimed is:

1. An apparatus for supplying a constant quantity of abrasive for a blasting machine that ejects a mixed fluid of compressed fluid and the abrasive from a blast gun, comprising:

an abrasive tank for storing abrasive, and in the abrasive tank further provided, an abrasive supplying conduit for conveying the abrasive, a rotating disk rotatably provided inside the abrasive tank at a position where the rotating disk is immersed in the abrasive stored in the abrasive tank; and a flow path having a gap being capable to rotate the rotating disk in an airtight state, wherein;

the flow path is consisted of a gas flow path and a mixed fluid flow path, the gas flow path being provided in the abrasive tank and isolated in an airtight state, the gas flow path feeds gas, the gas being compressed air or external air, the mixed fluid flow path is communicated with the gas flow path, and supplies a mixed fluid of gas for supplying abrasive and the abrasive, to a blast gun, and the rotating disk is provided with a plurality of hole sections and stirrer blades, and wherein the plurality of hole sections are formed, the hole sections being passed through the rotating disk in the thickness direction and having the same volume, and the positions where each hole section is are provided so as to be equally spaced on the rotating disk in a circumferential direction corresponding to a rotating locus passing through the gap of the flow path, and the stirrer blades are protruded from the rotating disk.

2. The apparatus for supplying a constant quantity of abrasive for a blasting machine according to claim 1, wherein the blasting machine is a suction type blasting machine, and one of two ends of the gas flow path constituting the flow path is opened outside the abrasive tank.

3. The apparatus for supplying a constant quantity of abrasive for a blast machine according to claim 1, wherein the blast machine is a direct pressure type blasting machine, and one of two ends of the gas flow path is communicated with a supply source for compressed fluid.

4. The apparatus for supplying a constant quantity of abrasive for a blasting machine according to claim 1, wherein the gas flow path is constituted by making the abrasive tank capable to be airtight, communicating the gas flow path with a compressed air supply source, opening one of two ends of the gas flow path inside the abrasive tank at a position that is higher than an uppermost filling position of the abrasive, and communicating one of two ends of the gas flow path with a compressed fluid supply source via a storing space of the abrasive tank.

5. The apparatus for supplying a constant quantity of abrasive for a blasting machine according to claim 1, wherein flanges for sliding contact with the rotating disk are provided on one of two ends of the mixed fluid flow path and the other one of two ends of the gas flow path.

6. The apparatus for supplying a constant quantity of abrasive for a blasting machine according to claim 1 wherein the stirrer blades have a rectangular plate shape.

7. The apparatus for supplying a constant quantity of abrasive for a blasting machine according to any one of claim 6, wherein a plurality of the stirrer blades are provided on the rotating disk, equally spaced in a circumferential direction.

8. The apparatus for supplying a constant quantity of abrasive for a blasting machine according to claim 1 wherein the stirrer blades are rod-shaped cylindrical bodies with a circular cross section.

9. The apparatus for supplying a constant quantity of abrasive for a blasting machine according to any one of claim 8, wherein a plurality of the stirrer blades are provided on the rotating disk, equally spaced in a circumferential direction.

10. The apparatus for supplying a constant quantity of abrasive for a blasting machine according to claim 8, wherein the hole sections are provided in a plurality of rows, being equally spaced concentrically in a circumferential direction of the rotating disk.

11. The apparatus for supplying a constant quantity of abrasive for a blasting machine according to any one of claim 1, wherein a plurality of the stirrer blades are provided on the rotating disk, equally spaced in a circumferential direction.

12. The apparatus for supplying a constant quantity of abrasive for a blasting machine according to claim 11, wherein the hole sections are provided in a plurality of rows, being equally spaced concentrically in a circumferential direction of the rotating disk.

13. The apparatus for supplying a constant quantity of abrasive for a blasting machine according to claim 1, wherein the hole sections are provided in a plurality of rows, being equally spaced concentrically in a circumferential direction of the rotating disk.

14. The apparatus for supplying a constant quantity of abrasive for a blasting machine according to claim 1, wherein the gap being capable to rotate the rotating disk is arranged at a position having the other one of two ends of the gas flow path facing one end of the mixed fluid flow path, to communicate the two flow paths.

* * * * *